US006358025B1

(12) United States Patent
Johansson

(10) Patent No.: US 6,358,025 B1
(45) Date of Patent: Mar. 19, 2002

(54) HYDRAULIC ROTATING AXIAL PISTON ENGINE

(75) Inventor: Ingvar Johansson, Hjartum (SE)

(73) Assignee: Parker Hannifin AB, Boras (SE)

( * ) Notice: Subject to any disclaimer, the term of this patent is extended or adjusted under 35 U.S.C. 154(b) by 0 days.

(21) Appl. No.: 09/633,022

(22) Filed: Aug. 4, 2000

Related U.S. Application Data

(63) Continuation of application No. PCT/SE99/00187, filed on Feb. 13, 1998.

(30) Foreign Application Priority Data

Feb. 13, 1998 (SE) ..... 9800412

(51) Int. Cl.[7] ..... F04B 7/04; F04B 39/10
(52) U.S. Cl. ..... 417/499; 417/269
(58) Field of Search ..... 417/269, 63, 485, 417/499; 91/499, 506; 92/129

(56) References Cited

U.S. PATENT DOCUMENTS

| | | | | |
|---|---|---|---|---|
| 3,793,924 A | | 2/1974 | Eickmann | |
| 3,834,281 A | * | 9/1974 | Heyl et al. | 91/506 |
| 4,223,594 A | | 9/1980 | Gherner | |
| 4,920,860 A | | 5/1990 | Alm et al. | |
| 4,934,253 A | | 6/1990 | Berthold et al. | |
| 5,176,066 A | | 1/1993 | Kanamaru et al. | |
| 5,253,983 A | * | 10/1993 | Suzuki et al. | 91/506 |
| 5,358,388 A | * | 10/1994 | Schutten et al. | 417/269 |
| 5,593,285 A | * | 1/1997 | Watts | 417/269 |
| 5,603,609 A | * | 2/1997 | Kadlicko | 417/63 |
| 5,636,561 A | * | 6/1997 | Pecorari | 91/499 |
| 6,092,457 A | * | 7/2000 | Inoue et al. | 92/129 |
| 6,287,086 B1 | * | 9/2001 | Steen | 417/269 |

FOREIGN PATENT DOCUMENTS

| | | | | |
|---|---|---|---|---|
| CH | 592 812 | | 11/1977 | |
| EP | 0 567 805 A1 | | 4/1993 | |
| FR | 2582738 | * | 5/1985 | F04B/1/20 |
| SE | 431 897 | | 5/1984 | |

OTHER PUBLICATIONS

Copy of the International Application Published Under the PCT in Case No. PCT/SE98/02218.
Copy of the International Application Published Under the PCT in Case No. PCT/SE99/00186.
Copy of the International Application Published Under the PCT in Case No. PCT/SE99/00187.

* cited by examiner

*Primary Examiner*—Teresa Walberg
*Assistant Examiner*—Leonid M Fastovsky
(74) *Attorney, Agent, or Firm*—Christopher H. Hunter

(57) ABSTRACT

A hydraulic rotating axial piston engine having a housing, enclosing a cylinder barrel journaled in the housing for rotation around a barrel axis. The housing also has a number of circumferentially arranged cylinders with a number of pistons reciprocating between two defined end positions. The pistons cooperate with an angled plate in order to obtain the reciprocating movement. The axial piston engine has an input/output shaft, and the cylinder barrel has channels connecting each cylinder to port(s) in the cylinder barrel. The ports alternatively act as inlet and outlet ports. The housing has an inlet and outlet channel, each having a kidney-shaped port, facing towards the inlet and outlet ports of the cylinder barrel. The kidney-shaped ports communicate with a number of the ports at the barrel. The cylinder barrel ports extend in both directions outside the cylinders in the two circumferential directions of the cylinder barrel. The channels open to the cylinders along the peripheral wall of each cylinder, and the opening to the cylinders has substantially the same area as the area of the ports of the barrel.

5 Claims, 9 Drawing Sheets

HYDRAULIC ROTATING AXIAL PISTON ENGINE

CROSS REFERENCE TO RELATED APPLICATIONS

This application is a continuation of copending International Application No. PCT/SE99/00187, which designated the United States, and claims priority to Swedish Patent Application 9800412-0, filed Feb. 13, 1998.

BACKGROUND OF THE INVENTION

A hydraulic piston engine is known from European Patent Reference EP-A1-0 567 805, having a number of axial cylinders, which are circumferentially arranged in a rotatable cylinder barrel. Each of the cylinders is provided with a channel, which alternatingly communicates with an inlet port or an outlet port in a housing. From this reference it is apparent that the dimension of the channel in the radial direction of the cylinder barrel is considerably less than the diameter of the cylinder assuming that the channel has a circular cross sectional shape. The cross sectional area of the channel is also considerably less than the cross sectional area of the corresponding cylinder. The result is that the maximum flow capacity of the cylinders and the total capacity of the engine is not fully utilized.

SUMMARY OF THE INVENTION

The object of the present invention is to provide a hydraulic rotating axial piston engine of the above discussed type having maximum flow capacity for a certain volume of the cylinders.

The present object is obtained by means of an engine according to the present invention, where the channels open to the cylinders along the peripheral wall of each cylinder. The opening to the cylinders has substantially the same area as the area of the ports of the barrel and extends completely outside the nearest end position of the piston in each cylinder.

The hydraulic rotating axial piston engine of the present invention has a housing enclosing a cylinder barrel journalled in the housing for rotation around a barrel axis, and a number of circumferentially arranged cylinders in the barrel with a number of pistons reciprocating between two defined end positions. The pistons cooperate with an angled plate in order to obtain the reciprocating movement. The axial piston engine has an input/output shaft. The cylinder barrel has channels connecting each cylinder to ports in the cylinder barrel, the ports alternatively acting as inlet and outlet ports. The housing has at least one inlet and outlet channel, each having a kidney shaped port, facing towards the inlet and outlet ports of the cylinder barrel. The kidney shaped ports communicate with a number of the ports at the barrel. At least a number of the cylinder barrel ports extend in both directions outside the cylinders in the two circumferential directions of the cylinder barrel.

Further features of the present invention will become apparent to those skilled in the art upon reviewing the following specification and attached drawings.

DETAILED DESCRIPTION OF THE PREFERRED EMBODIMENT

Figure 1:
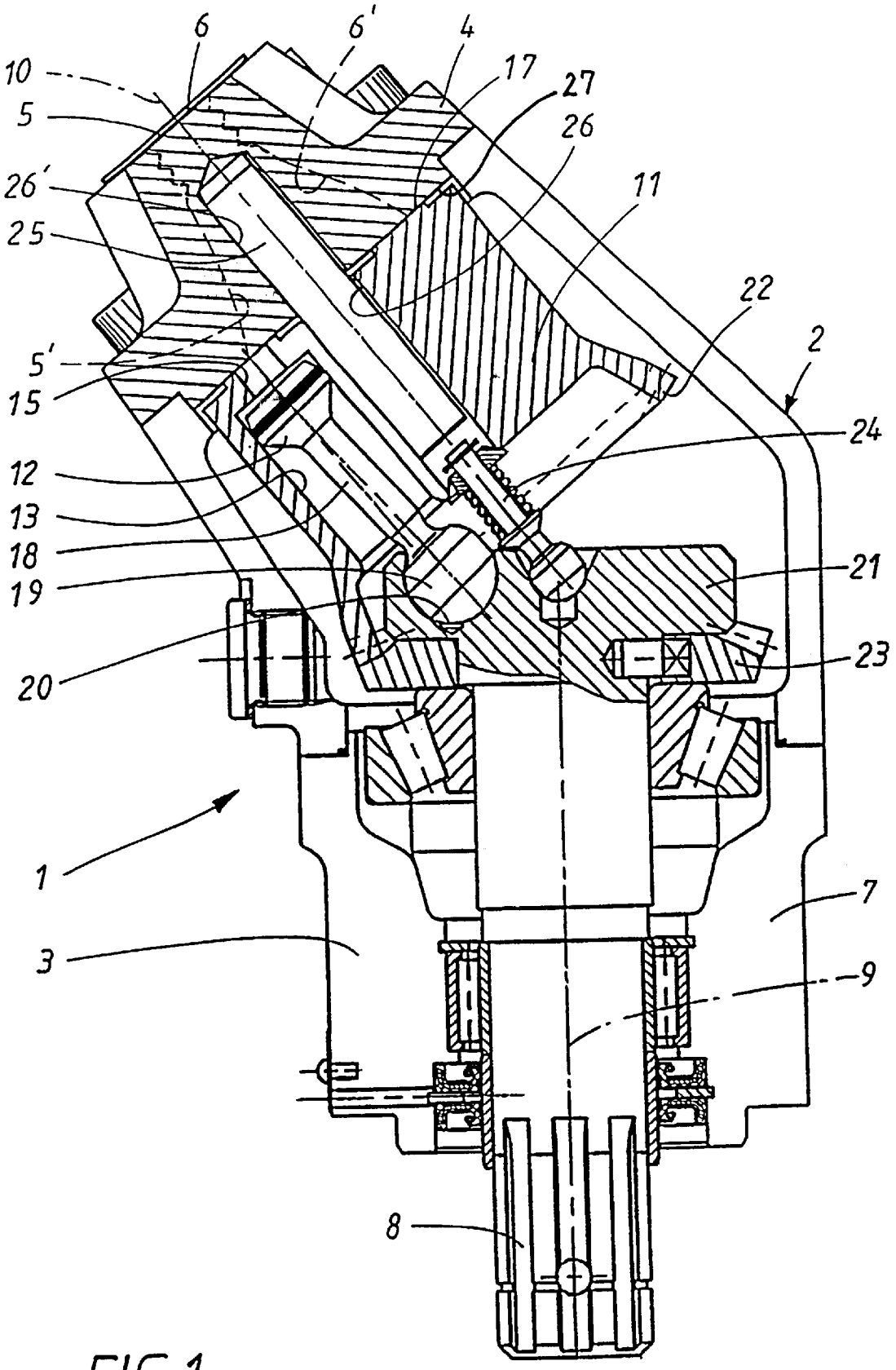
FIG. 1 shows an axial section of a pump according to the present invention, according to a first embodiment.
Figure 2:
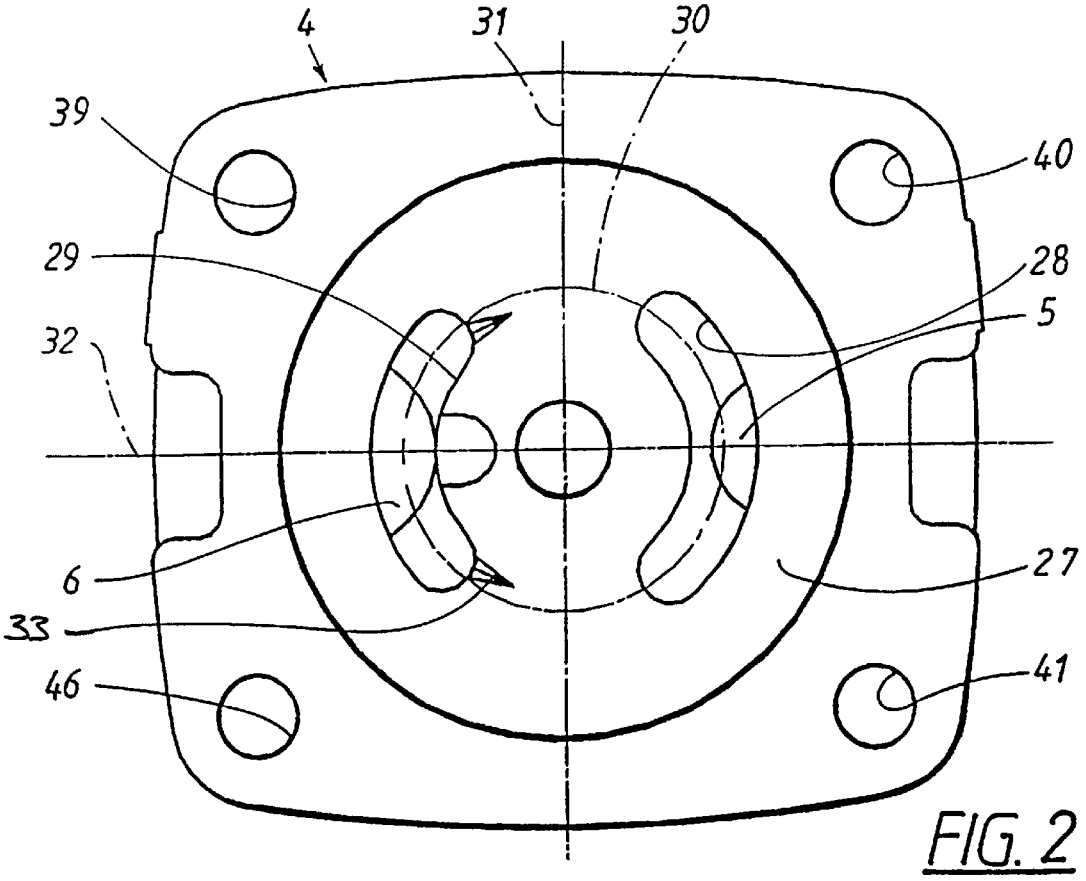
FIG. 2 is a plan view of a connecting part in the first embodiment of the pump as seen separately from the inside.
Figure 3:
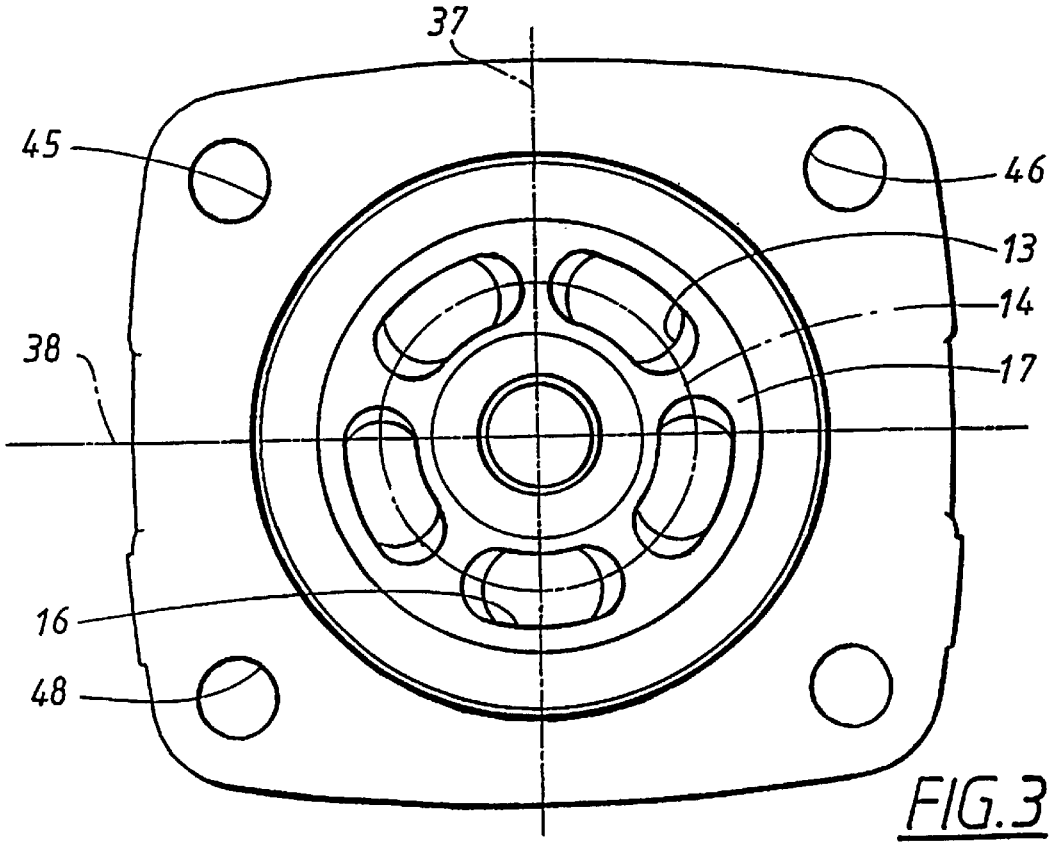
FIG. 3 is an end view of a housing part of the pump according to FIG. 1.
Figure 4:
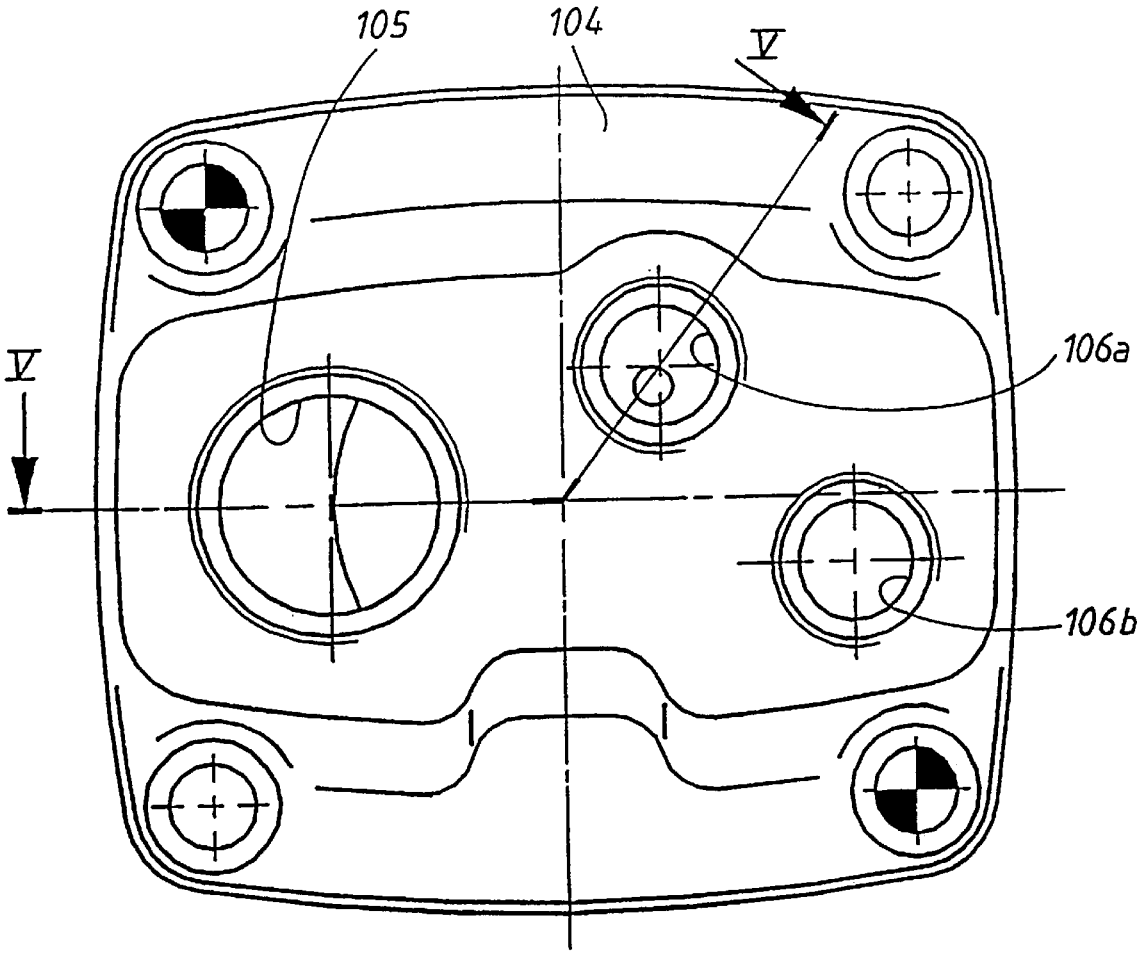
FIG. 4 is an end view of the connecting part in a second embodiment of the pump.

The hydraulic rotating axial piston engine according to a first embodiment of the present invention is shown in FIGS. 1–3 as an axial piston pump, indicated generally at 1. The pump has a housing, indicated generally at 2, which is comprised by at least two parts. Three parts are shown, namely a housing part 3 and a connecting part 4, having connecting openings, namely an inlet opening 5 and an outlet opening 6 for connecting input and output conduits for hydraulic fluid to and from the pump respectively. A third part 7 of the housing is a support part for the input shaft 8 which is provided to be connected with a drive motor, not shown.

In FIG. 1 the general parts of the pump are shown. The pump is of a so-called "bent axis" type, having a first rotational axis 9, forming a rotational axis for the input shaft 8, and a second rotational axis 10 inclined relative to the first axis by an angle of for example 40°. The second rotational axis is an axis for a cylinder barrel 11 which is rotatably journalled in the housing. The cylinder barrel 11 has a number of axially extending pistons 12, movable axially, i.e., substantially in parallel with the axis 10 in a reciprocating movement in a corresponding number of cylinders 13. Cylinders 13 also extend axially with the axis 10, and are circumferentially equally spaced along a circle line 14 (see FIG. 3). Each cylinder 13 has a fluid passage or channel 15 with a port 16 in the planar end surface 17 of the cylinder barrel 11. Each opening 16 has its largest length along the peripheral circle line 14, and is kidney-shaped.

From FIG. 1 it is further apparent that each piston 12 has a piston rod 18 with a spherical head 19. The spherical heads are supported in spherical bearing surfaces, forming recesses 20 in a swash plate 21, which forms an integral part of the input shaft 8. The spherical recesses 20 are rotatable around a radial plane which is angled relative to the radial plane of the cylinder barrel 11. This results in the reciprocating movement of the pistons 12 and the pumping action according to a prior known principle, in order to create vacuum, i.e., suction in the inlet opening 5 and pressure in the outlet opening 6 (see for example U.S. Pat. No. 5,176,066).

Synchronizing means are arranged in order to synchronize the rotational movements of the cylinder barrel with the rotation of the swash plate 21. In the shown example, the synchronizing means is made in the form of tooth gear formed by a tooth wheel rim 22 on the cylinder barrel cooperating with a tooth wheel 23 of the input shaft 8. A support pin 24 supports the cylinder barrel 11 along the axis 10. The support pin 24 cooperates with a shaft 25 which forms the rotational axis 10 and projects through a bore 26 of the cylinder barrel. The shaft 25 is supported in a bore 26' of the connecting piece 4 of the housing.

FIG. 2 shows the connecting part 4 of the housing separately and from the inside. The connecting part 4 has on its inside a substantially planar, circular surface 27 which in the mounted position faces the planar surface 17 of the cylinder barrel 11. The two planar surfaces 17, 27 are arranged to contact each other with a sealing fit. On its inside the connecting part 4 is provided with one inlet port 28 and one outlet port 29, each of which are kidney-shaped. The inlet port 28 communicates through a channel 5' (FIG. 1) with the inlet opening 5, and the inner outlet port 29 communicates through a separate channel 6' with the outlet opening 6 on the outside of the connecting part 4.

The inlet and outlet ports 28, 29 extend along a peripheral circle line 30 which has a corresponding radius as the circle line 14 of the openings 16 of the cylinder barrel 11. The inlet and outlet openings 28, 29 extend on each half of the circle line 30, separated by a main plane 31 extending through the connecting part 4. The inlet and outlet port 28, 29 are further divided by a second main plane 32 extending 90° relative to the first main plane 31. The inlet and outlet ports 28, 29 further extend along the circle line 30 along a predetermined peripheral angle, which in the shown example is somewhat larger for the inlet opening 5 than for the outlet opening 6, and are arranged so that simultaneously more than one cylinder port 16 communicates with the inlet port 28 and the outlet port 29, respectively. The inlet and outlet ports 28, 29 can be provided with slit extensions as a t33, the ends of which determine the total angular extension of the inlet and outlet ports.

In the above first embodiment there has been described a so-called single pump, serving a single hydraulic system by means of one single outlet pressure opening 6. Therefore there is one single fluid passage and one single inner port 29. Consequently the cylinder barrel has one single set of cylinders circumferentially positioned along one single peripheral circle line 14.

Figure 5:
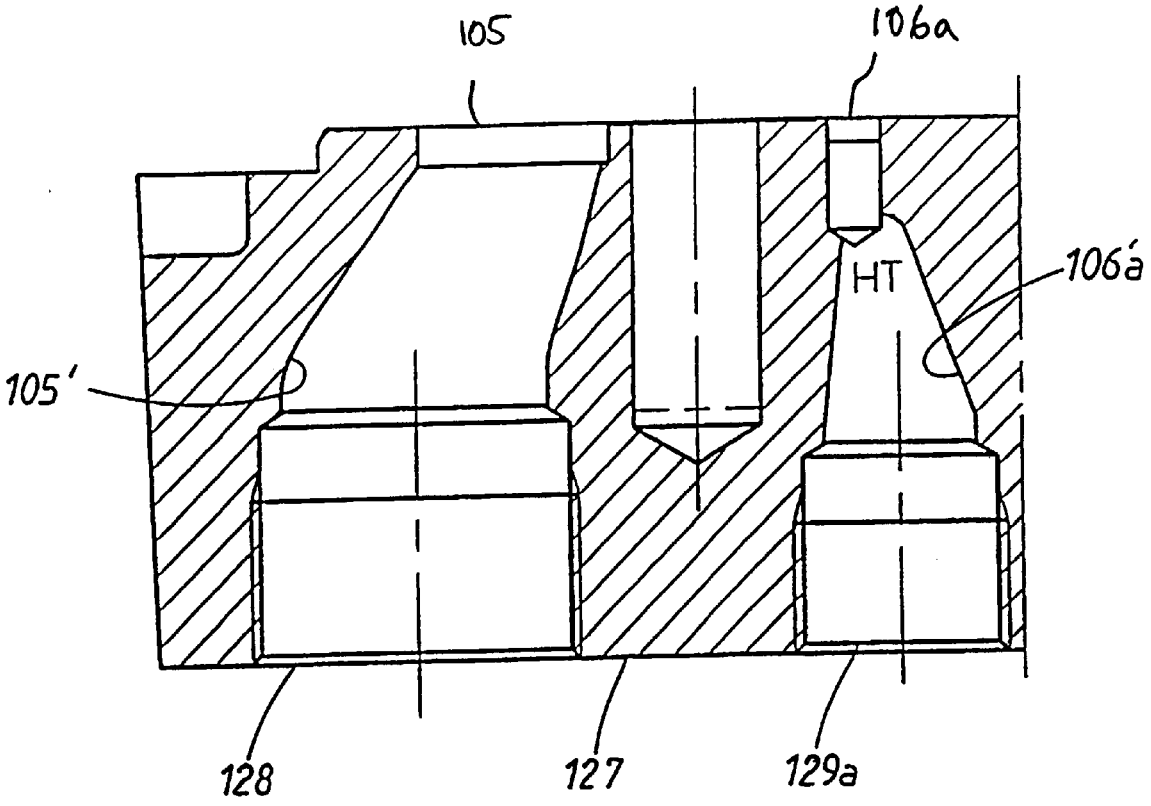
FIG. 5 is a cross sectional view of the pump along the lines V—V in FIG. 4.

In a second embodiment there is shown a so-called double pump, serving two independent hydraulic systems. The second embodiment will now be described with reference particularly to FIGS. 4–9. From the end view of the connecting part 104 it is apparent that in the double pump there are two outlet pressure openings 106*a*, 106*b*. The inlet suction opening 105 is dimensioned to receive sufficient flow of fluid in order to serve the two outlet openings and the corresponding hydraulic systems. By means of the section in FIG. 5 the extension of the fluid passages 105' and 106'*a* are shown as an example, as well as the inlet port 128 and one of the outlet ports 129*a*. Also the planar surface 127 is shown facing the end surface of the cylinder barrel.

Figure 6:
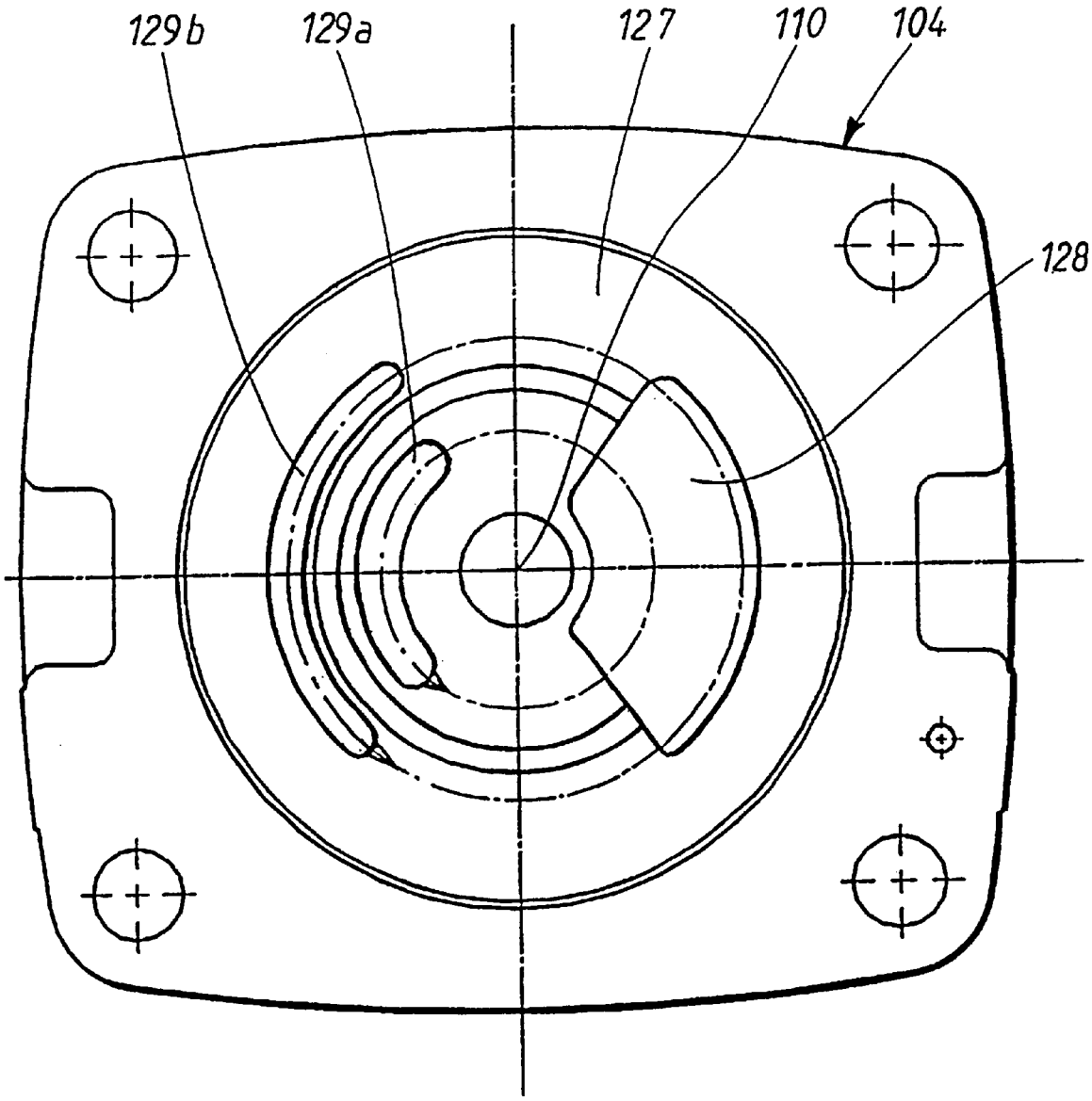
FIG. 6 is a plan view of the connecting part in the second embodiment of the pump as seen separately from the inside.
Figure 7:
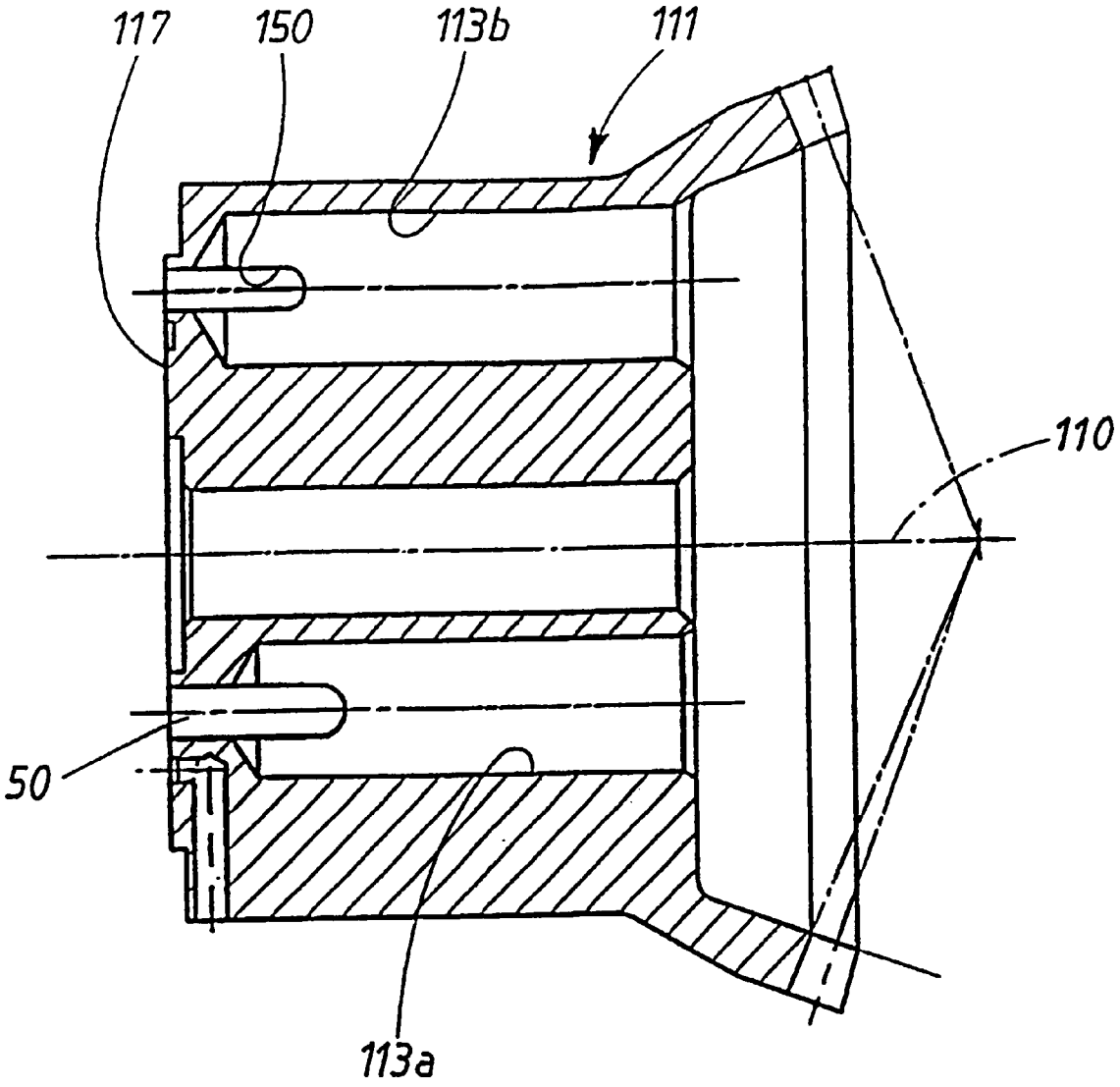
FIG. 7 is an axial section of a cylinder barrel of the pump according to the second embodiment.
Figure 8:
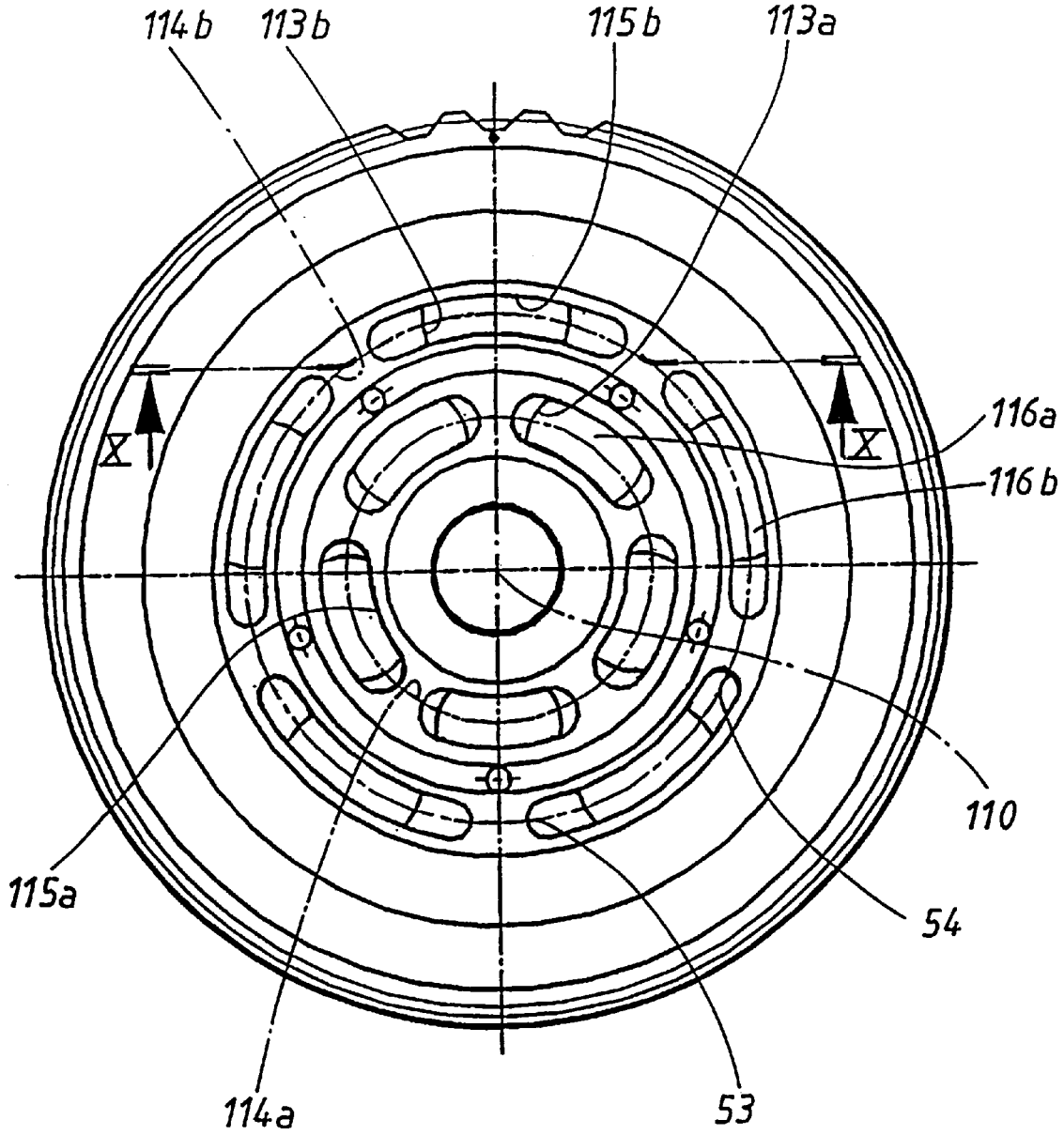
FIG. 8 is an end view of the cylinder barrel as seen from the connecting part.
Figure 9:
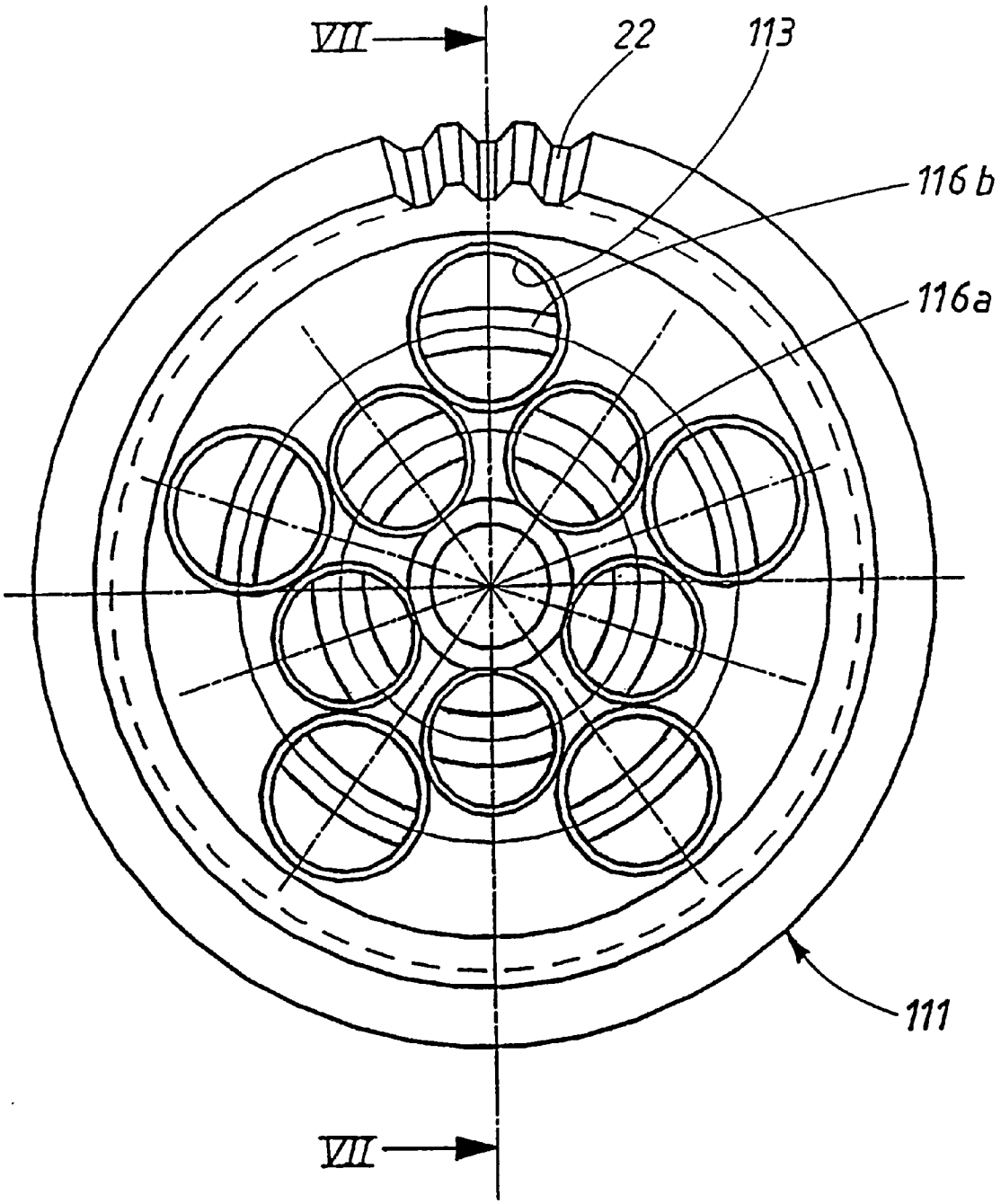
FIG. 9 is an end view of the cylinder barrel as seen from the opposite end.

From FIG. 6 it is apparent that the inlet port 128 has considerable radial extension contrary to the outlet ports 129*a*, 129*b*, and all extend substantially concentrically relative to the second rotational axis 110, which is the axis for the cylinder barrel 111, as shown in FIGS. 7–9.

From FIGS. 7–9 it is apparent that in the second embodiment there are two sets of axial cylinders 113*a*, 113*b* which are circumferentially arranged around the rotational axis 110. An inner set of cylinders 113*a* are equally spaced along an inner circle line 114*a*; and an outer set of cylinders 113*b* are equally spaced along an outer circle line 114*b*.

Especially when having two circumferentially arranged sets of cylinders 113*a*, 113*b* the radial space in the planar end surface 117 facing the planar inner surface 127 of the connecting piece is very limited, as the radially inner set of cylinders has to communicate with the radially inner pressure port 129*a*, and the radially outer set of cylinders 113*b* has to communicate with the radially outer pressure port 29*b*. However, the cylinder ports 11 6*a*, 11 6*b* are highly extended along their circle lines 114*a*, 114*b* respectively. This is especially expressed in the outer set of cylinder ports 116*b*. It is particularly important that the cross sectional area of the cylinder barrel ports 116*a*, 116*b* is as large as possible and not too much smaller than the cross sectional area of the cylinders. It is also important that the cylinder barrel ports 116*a*, 116*b* do not reduce the flow capacity of the pump as a whole.

Figure 10:
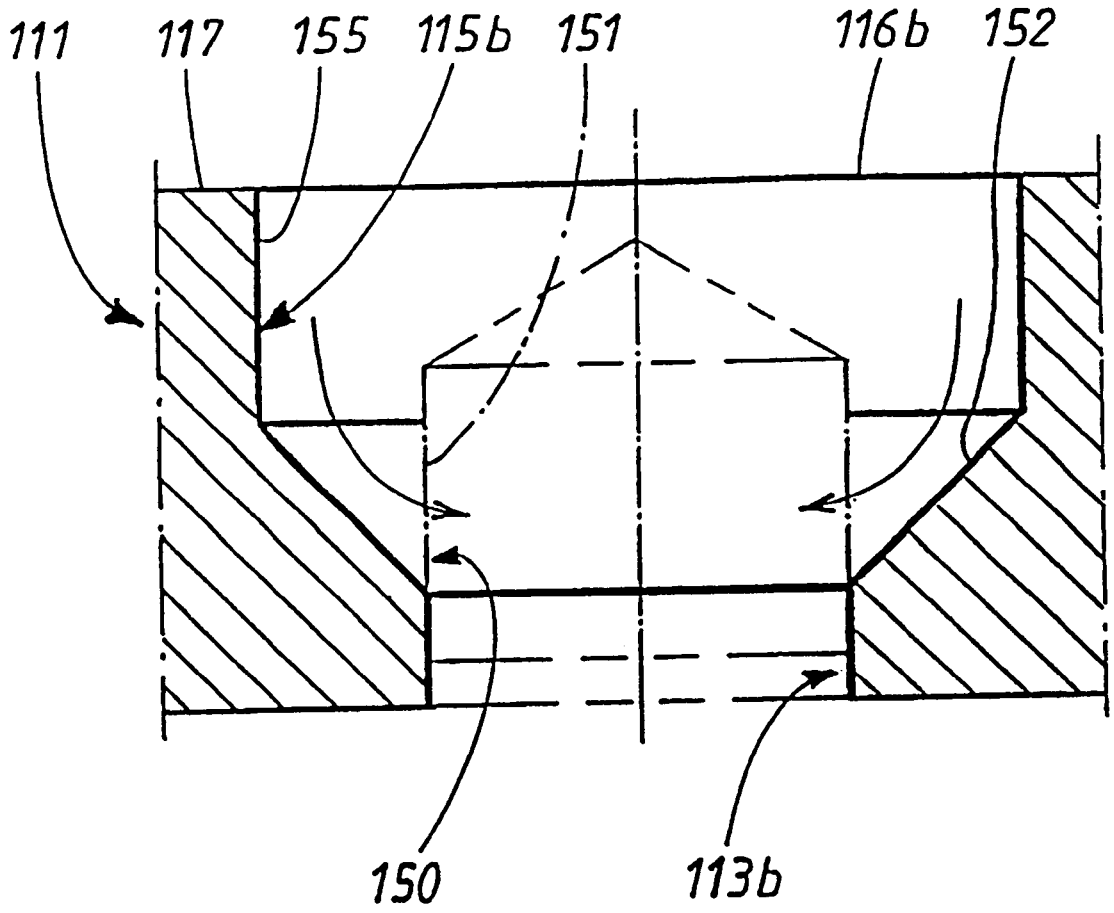
FIG. 10 is a partial section of the cylinder barrel along the lines X—X according to FIG. 8.

However, it is not only the cross sectional area of the cylinder barrel ports 116*a*, 116*b* in the cylinder barrel end surface that is important for the flow capacity. From the sectional view of FIG. 10, the section through one of the radially outer cylinder port channels 115*b* is shown. In the radially outer cylinder port channels, it is especially visible that according to the present invention the channel 115*b* has an inner opening 150 to the cylinder which extends along the peripheral wall 151 of the cylinder, and has substantially the same area as the area of the ports of the barrel. Furthermore, the cross sectional area of each channel 115*b* is nowhere less than the area of the opening 150. Furthermore, as seen best in FIG. 7, the opening 150 has a contour line which is U-shaped. It is apparent from FIG. 10 that the opposite walls 152 at the end portions 153, 154 converge in direction towards the inner opening 150 of the channel 115*b*. Walls 152 pass near the opening 150 over to a wall portion 155 which extends to the planar end surface 117 of the cylinder barrel 111. The transition between wall 152 and the wall portion 155 forms an angle exceeding 90 degrees.

By means of the shape and the arrangement of the cylinder port channels 115*b*, the channels will not form a limitation of the flow capacity of the pump which substantially will be determined by the volume of the cylinders 113*a*, 113*b*.

The extension of the cylinder barrel ports 116*a*, 116*b* along their peripheral circle lines 114*a*, 114*b*, and also the corresponding peripheral extension of the suction port 128 and pressure ports 129*a*, 129*b*, determines the time sequence and operation of the cylinder barrel ports as alternatingly suction ports and pressure ports. The ports are in syncronization with the angular positions in the end positions, i.e., for upper dead point (UPD) and lower dead point (LDP) for the pistons in a principally prior known manner. Further, the opening extends along the peripheral wall of the cylinders along at least the outer circle line 114*b* completely outside the nearest end position of the piston in the cylinder. However, in the example as shown in FIGS. 8 and 9, the openings extend along the peripheral wall of the cylinders along both circle lines 114*a*, 114*b*.

The design of the cylinder barrel channels has been described and shown with reference to the second embodiment with the double pump. However, the same principle is applied to the single pump in order to achieve a maximum of capacity for a certain cylinder volume. The detailed shape of the channel can be modified without changing the principle of the present invention. For example, the peripheral extension as described and shown can be excluded for the openings of the cylinders along the inner circle line 116*a*.

What is claimed is:

1. A hydraulic rotating axial piston engine, comprising:

a housing enclosing a cylinder barrel journalled in said housing for rotation around a barrel axis, and having a number of circumferentially arranged cylinders with a number of pistons reciprocating between two defined end positions, said pistons cooperating with an angled plate in order to obtain said reciprocating movement, said axial piston engine having an input/output shaft, said cylinder barrel having channels connecting each cylinder to ports in the cylinder barrel, said ports alternatively acting as inlet and outlet ports, said housing having at least one inlet and outlet channel, each having a kidney shaped port facing towards said inlet and outlet ports of said cylinder barrel, said kidney shaped ports communicating with a number of said ports of said barrel, at least one of said cylinder barrel ports extending in both directions outside the cylinders in the two circumferential directions of the cylinder barrel, wherein said channels have an opening to said cylinders along a peripheral wall of each cylinder, said opening to said cylinders having substantially the same area as the area of the ports of the barrel and extending completely outside the nearest end position of said piston in each cylinder.

2. A hydraulic rotating axial piston engine according to claim 1, wherein said engine is a pump, driven by means of a motor, applying a torque to the input shaft.

3. A hydraulic rotating axial piston engine according to claim 2, wherein said input shaft is angled relative to the axis of the cylinder barrel rotatable with said angled plate.

4. A hydraulic rotating axial piston engine according to claim 3, wherein said cylinder barrel ports are circumferentially arranged along two concentric circle lines and communicate with two separate kidney shaped ports in the housing.

5. A hydraulic rotating axial piston engine according to claim 1, wherein said opening has a U-shaped contour line.

* * * * *